US010443927B2

(12) United States Patent
Manning et al.

(10) Patent No.: US 10,443,927 B2
(45) Date of Patent: Oct. 15, 2019

(54) MIXED REFRIGERANT DISTRIBUTED CHILLING SCHEME

(71) Applicant: Black & Veatch Holding Company, Overland Park, KS (US)

(72) Inventors: Jason M. Manning, Overland Park, KS (US); Justin Ellrich, Overland Park, KS (US); Shawn D. Hoffart, Overland Park, KS (US)

(73) Assignee: Black & Veatch Holding Company, Overland Park, KS (US)

( * ) Notice: Subject to any disclaimer, the term of this patent is extended or adjusted under 35 U.S.C. 154(b) by 295 days.

(21) Appl. No.: 15/255,805

(22) Filed: Sep. 2, 2016

(65) Prior Publication Data

US 2017/0067684 A1 Mar. 9, 2017

Related U.S. Application Data

(60) Provisional application No. 62/216,226, filed on Sep. 9, 2015.

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0212* (2013.01); *F25J 1/0236* (2013.01); *F25J 1/0283* (2013.01); *F25J 1/0291* (2013.01); *F25J 2220/64* (2013.01)

(58) Field of Classification Search
CPC ..... F25J 1/0022; F25J 1/0212; F25J 1/0283; F25J 1/0291; F25J 1/0216; F25J 1/0227
See application file for complete search history.

(56) References Cited

U.S. PATENT DOCUMENTS

| | | | | |
|---|---|---|---|---|
| 3,763,658 | A * | 10/1973 | Gaumer, Jr. | F25J 1/0022 62/335 |
| 4,339,253 | A * | 7/1982 | Caetani | F25J 1/0022 62/612 |
| 4,545,795 | A * | 10/1985 | Liu | F25J 1/0022 62/613 |
| 5,457,951 | A | 10/1995 | Johnson et al. | |
| 5,669,234 | A | 9/1997 | Houser et al. | |
| 6,016,665 | A | 1/2000 | Cole et al. | |
| 6,119,479 | A | 9/2000 | Roberts et al. | |
| 6,250,244 | B1 | 6/2001 | Dubar et al. | |
| 6,289,692 | B1 | 9/2001 | Houser et al. | |
| 6,308,531 | B1 | 10/2001 | Roberts et al. | |
| 6,324,867 | B1 * | 12/2001 | Fanning | F25J 1/0022 60/728 |
| 6,374,591 | B1 | 4/2002 | Johnson et al. | |
| 7,131,272 | B2 | 11/2006 | Jones, Jr. et al. | |
| 2010/0313597 | A1 | 12/2010 | Bridgwood | |

(Continued)

*Primary Examiner* — Keith M Raymond
(74) *Attorney, Agent, or Firm* — Hovey Williams LLP

(57) ABSTRACT

Processes and systems are provided for recovering a liquid natural gas ("LNG") from a hydrocarbon-containing gas. More particularly, the present invention is generally related to processes and systems that optimize the chilling efficiencies of an LNG facility through the utilization of an auxiliary refrigeration cycle. Additionally, the present invention is also generally related to the rerouting of mixed refrigerants in a closed-loop refrigeration cycle in order to optimize the chilling efficiencies of the LNG facility.

15 Claims, 3 Drawing Sheets

(56) References Cited

U.S. PATENT DOCUMENTS

| | | | | |
|---|---|---|---|---|
| 2012/0060552 | A1* | 3/2012 | Van De Lisdonk .. | F01D 15/005<br>62/611 |
| 2012/0090351 | A1 | 4/2012 | Van De Lisdonk et al. | |
| 2013/0074511 | A1 | 3/2013 | Tanaeva et al. | |

* cited by examiner

MIXED REFRIGERANT DISTRIBUTED CHILLING SCHEME

RELATED APPLICATIONS

This application claims the priority benefit under 35 U.S.C. § 119(e) of U.S. Provisional Patent Application Ser. No. 62/216,226 entitled "MIXED REFRIGERANT DISTRIBUTED CHILLING SCHEME," filed Sep. 9, 2015, the entire disclosure of which is incorporated herein by reference.

BACKGROUND

1. Field of the Invention

The present invention is generally related to processes and systems for recovering a liquid natural gas ("LNG") from a hydrocarbon-containing gas. More particularly, the present invention is generally related to processes and systems that maximize the chilling efficiencies of an LNG facility.

2. Description of the Related Art

Refrigerant systems are utilized in LNG production facilities to provide the cooling necessary to liquefy natural gas. The specific configuration or type of refrigerant system can largely influence the efficiency and operability of the plant. However, regardless of the configuration or the type of refrigerant system utilized, many operational and configuration inefficiencies may exist within the LNG production facilities that inhibit the optimal performance of the refrigerant systems. Therefore, there is a need for LNG production facilities that better optimize their refrigerant systems.

SUMMARY

One or more embodiments of the present invention concern a process for producing liquid methane gas in an LNG liquefaction plant. Generally, the process comprises: (a) cooling a condensed mixed refrigerant and a heat transfer stream via indirect heat exchange with an expanded mixed refrigerant to thereby form a cooled mixed refrigerant, a cooled heat transfer stream, and a warmed mixed refrigerant; and (b) performing at least one of the following: (i) cooling a feed gas with the cooled heat transfer stream prior to introducing the feed gas into a dehydration unit; (ii) cooling the inlet air stream of a turbine with the cooled heat transfer stream; or (iii) routing the cooled heat transfer stream to other cooling processes in the LNG liquefaction plant to thereby increase plant efficiency, capacity, or product purity.

One or more embodiments of the present invention concern a process for producing liquid methane gas in an LNG liquefaction plant. Generally, the process comprises: (a) cooling a hydrocarbon-containing gas with a first closed refrigeration loop comprising a first mixed refrigerant and an optional second closed refrigeration loop comprising a second mixed refrigerant; (b) cooling the first mixed refrigerant and/or a heat transfer fluid with an expanded mixed refrigerant to thereby form a cooled mixed refrigerant and/or a cooled heat transfer stream; and (c) cooling the uncompressed inlet air stream of a turbine with the cooled mixed refrigerant and/or the cooled heat transfer stream.

One or more embodiments of the present invention concern a facility for recovering liquid methane gas (LNG) from a hydrocarbon-containing gas. Generally, the facility comprises: (i) a primary heat exchanger having a first cooling pass disposed therein, wherein the first cooling pass is configured to cool the hydrocarbon-containing gas into a cooled hydrocarbon-containing gas; (ii) an indirect heat exchanger having a second cooling pass disposed therein, wherein the second cooling pass is configured to cool a heat transfer fluid comprising water, a glycol, or a mixture thereof into a cooled heat transfer fluid; (iii) a single closed-loop mixed refrigeration cycle at least partially disposed within the primary heat exchanger and the indirect heat exchanger; and (iv) a conduit directing the cooled heat transfer fluid from the second cooling pass to at least one of the following: (a) a third heat exchanger having a third cooling pass configured to cool the inlet air stream to a turbine, (b) a fourth heat exchanger having a fourth cooling pass configured to cool the hydrocarbon-containing gas prior to the first cooling pass, (c) a fifth heat exchanger having a fifth cooling pass configured to cool the overhead stream from a distillation column, or (d) a sixth heat exchanger having a sixth cooling pass configured to cool the condensed stream from a condenser. Furthermore, the single closed-loop refrigeration cycle comprises: (a) a refrigerant compressor defining a suction inlet for receiving a mixed refrigerant stream and a discharge outlet for discharging a stream of compressed mixed refrigerant; (b) a first refrigerant cooling pass in fluid communication with the discharge outlet of the refrigerant compressor, wherein the first refrigerant cooling pass is configured to cool the compressed mixed refrigerant stream in the primary heat exchanger; (c) a first refrigerant expansion device in fluid communication with the first refrigerant cooling pass, wherein the first refrigerant expansion device is configured to expand the cooled mixed refrigerant stream and generate refrigeration; (d) a first refrigerant warming pass in fluid communication with the refrigerant expansion device and the suction inlet of the refrigerant compressor, wherein the first refrigerant warming pass is configured to warm the expanded mixed refrigerant stream in the primary heat exchanger via indirect heat exchange; (e) a second refrigerant cooling pass configured to cool at least a portion of the mixed refrigerant stream in the indirect heat exchanger; (f) a second refrigerant expansion device in fluid communication with the second refrigerant cooling pass, wherein the second refrigerant expansion device is configured to expand the mixed refrigerant stream from the second refrigerant cooling pass and generate refrigeration; and (g) a second refrigerant warming pass in fluid communication with the second refrigerant expansion device, wherein the second refrigerant warming pass is configured to warm the mixed refrigerant stream from the second refrigerant expansion device in the indirect heat exchanger via indirect heat exchange.

BRIEF DESCRIPTION OF THE FIGURES

Embodiments of the present invention are described herein with reference to the following drawing figures, wherein.

DETAILED DESCRIPTION

The following detailed description of embodiments of the invention references the accompanying drawings. The embodiments are intended to describe various aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

The present invention is generally related to processes and systems that maximize the chilling efficiencies of an LNG facility. In particular, the present invention provides numerous LNG plant configurations that efficiently provide chilling to other process loads within the LNG plant, thereby optimizing the cooling efficiency of the refrigerant systems. Consequently, the present invention can increase the overall efficiency of the described LNG facilities.

Figure 2:
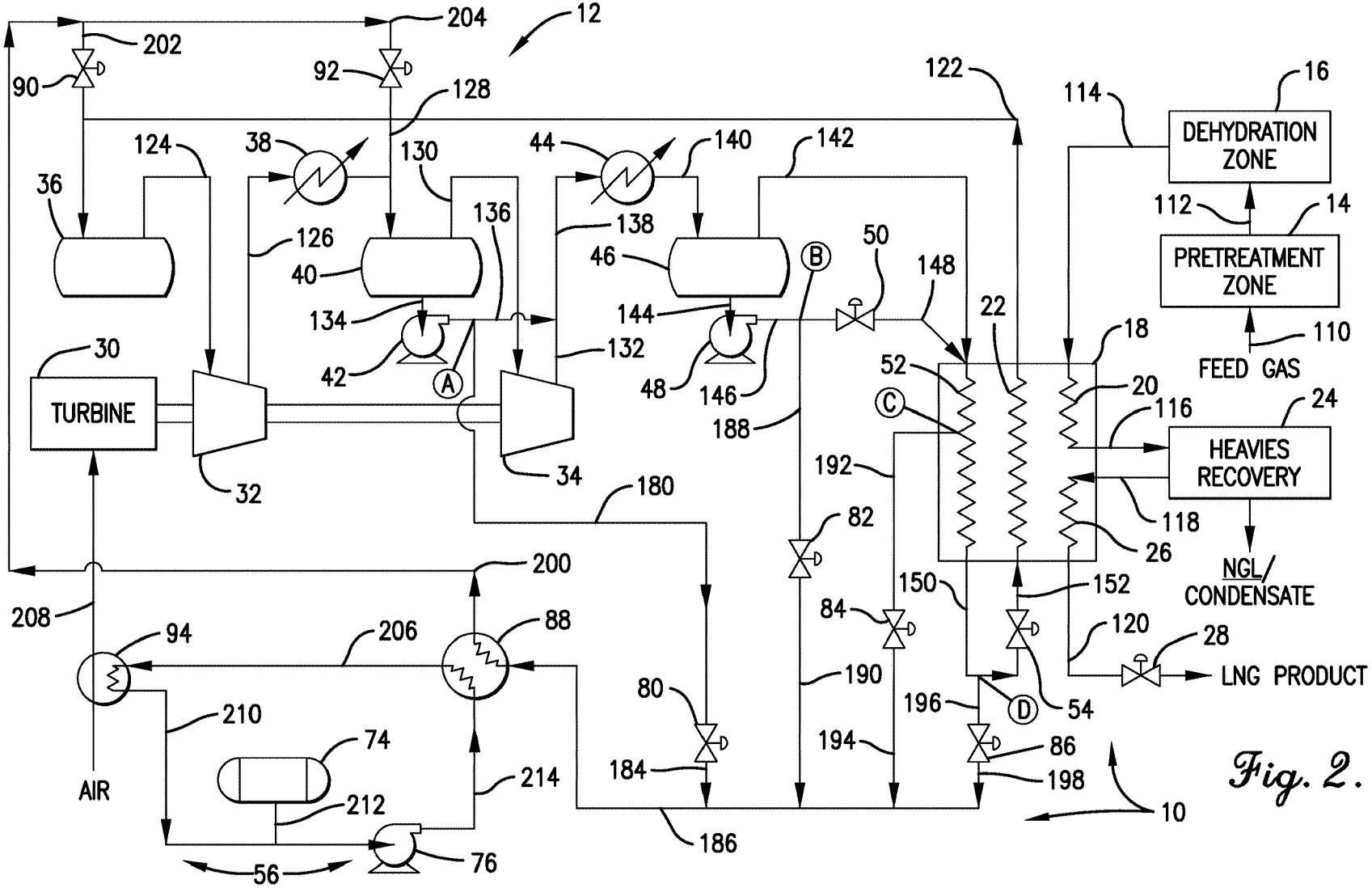
FIG. 2 provides a schematic depiction of an LNG recovery facility configured according to one embodiment of the present invention, particularly illustrating the use of a single closed-loop mixed refrigerant system and a water chiller to recover methane from a feed gas stream.
Figure 3:
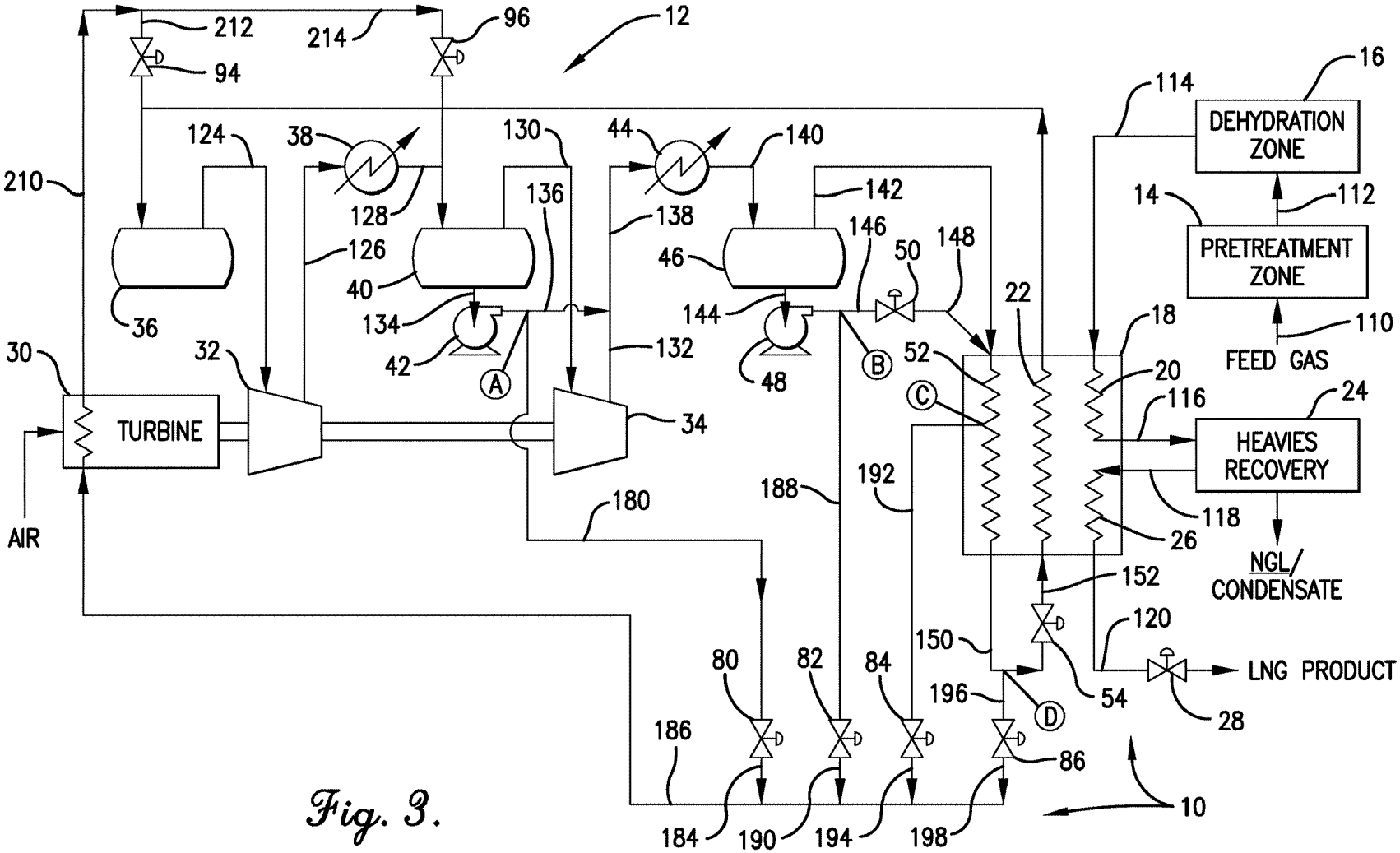
FIG. 3 provides a schematic depiction of an LNG recovery facility configured according to one embodiment of the present invention, particularly illustrating the use of a single closed-loop mixed refrigerant system to recover methane from a feed gas stream.

As described below, these processes and systems can utilize a refrigerant system to assist in the recovery of methane from the hydrocarbon-containing gases. Although FIGS. 1-3 depict this refrigerant system as comprising a single closed-loop mixed refrigeration cycle, one skilled in the art would appreciate that another refrigerant system can be used in the process and system described below.

For example, the refrigerant system can comprise, consist essentially of, or consist of a single mixed refrigerant (SMR) stream in a closed-loop refrigeration cycle, a dual mixed refrigerant (DMR) cycle, or a cascade refrigeration cycle. Such refrigeration systems are described in U.S. Pat. Nos. 3,763,658, 5,669,234, 6,016,665, 6,119,479, 6,289,692, and 6,308,531, the disclosures of which are incorporated herein by reference in their entireties. In one or more embodiments of the present invention, the refrigerant systems that are used to cool a hydrocarbon-containing gas feed stream and produce an LNG product comprise, consist essentially of, or consist of a single mixed refrigerant (SMR) stream in a closed-loop refrigeration cycle. In such embodiments, the hydrocarbon-containing gas feed stream can be cooled and the LNG product formed using only the single mixed refrigerant (SMR) stream in a closed-loop refrigeration cycle with no other refrigerant systems or cycles being present or used in the LNG facility to directly liquefy and produce the LNG product. In certain embodiments of the present invention, the LNG facilities described herein do not contain a cascade refrigeration cycle.

Figure 1:
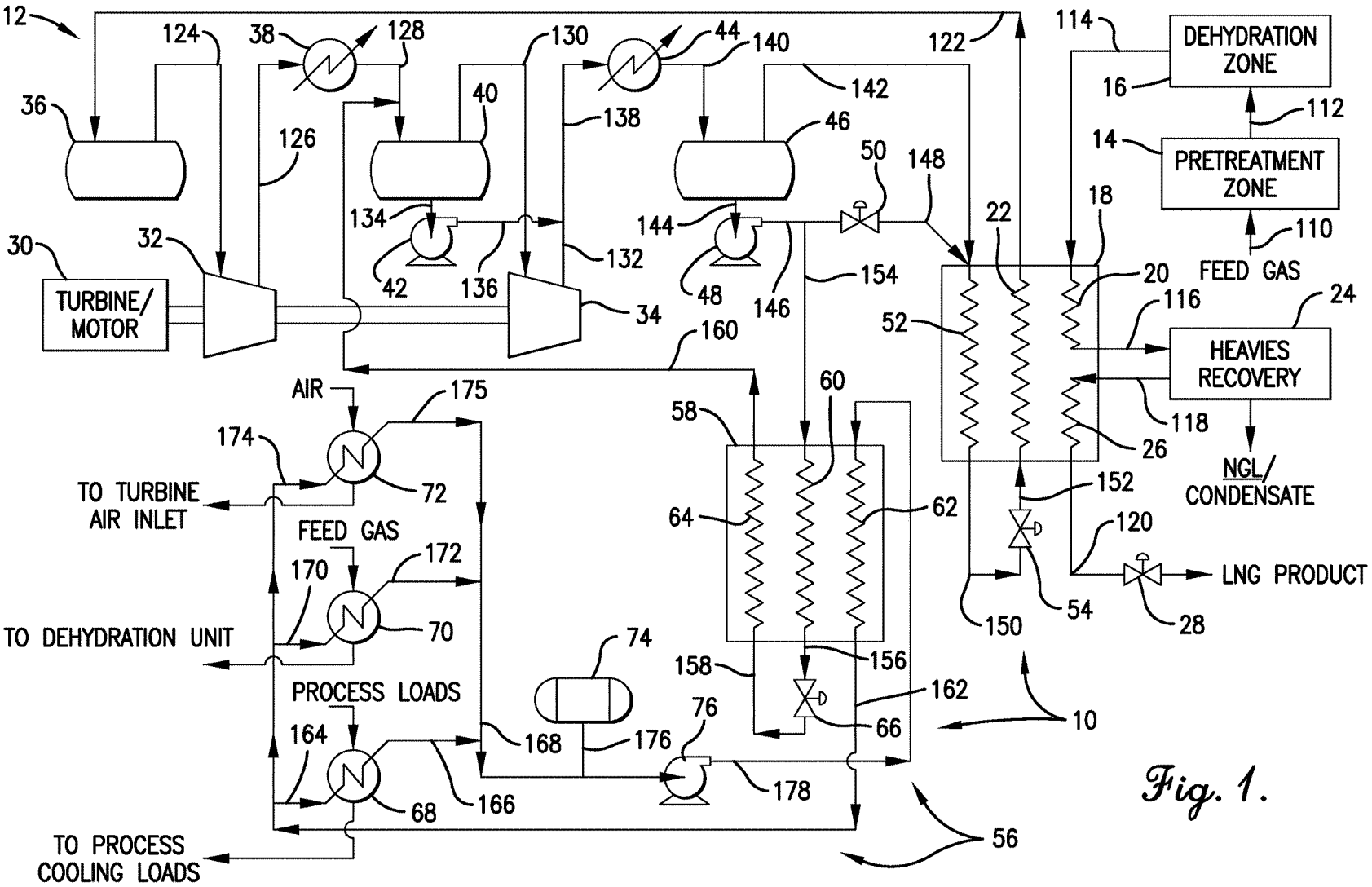
FIG. 1 provides a schematic depiction of an LNG recovery facility configured according to one embodiment of the present invention, particularly illustrating the use of a single closed-loop mixed refrigerant system and a water chiller to recover methane from a feed gas stream.

Turning now to FIG. 1, a schematic depiction of an LNG recovery facility 10 configured according to one or more embodiments of the present invention is provided. The LNG recovery facility 10 can be operable to remove or recover a substantial portion of the total amount of methane in the incoming hydrocarbon-containing gas stream by cooling the gas with a single closed-loop refrigeration cycle 12. Additional details regarding the configuration and operation of LNG recovery facility 10, according to various embodiments of the present invention, are described below in reference to FIG. 1.

As shown in FIG. 1, a hydrocarbon-containing gas feed stream can initially be introduced into the LNG recovery facility 10 via conduit 110. The hydrocarbon-containing gas can be any suitable hydrocarbon-containing fluid stream, such as, for example, a natural gas stream, a syngas stream, a cracked gas stream, associated gas from oil production, or combinations thereof. The hydrocarbon-containing gas stream in conduit 110 can originate from a variety of gas sources (not shown), including, but not limited to, a natural gas pipeline distribution network; a petroleum production well; a refinery processing unit, such as a fluidized catalytic cracker (FCC) or petroleum coker; or a heavy oil processing unit, such as an oil sands upgrader. In certain embodiments, the hydrocarbon-containing gas in conduit 110 can comprise or consist of a syngas.

Depending on its source, the hydrocarbon-containing gas can comprise varying amounts of methane, nitrogen, hydrogen, carbon monoxide, carbon dioxide, sulfur-containing species, and other hydrocarbons. For example, the hydrocarbon-containing gas can comprise at least 1, 5, 10, 15, or 25 and/or not more than 99, 95, 90, 80, 70, or 60 mole percent of methane. More particularly, the hydrocarbon-containing gas can comprise in the range of 1 to 99, 5 to 95, 10 to 90, 15 to 80, or 25 to 70 mole percent of methane. It should be noted that all mole percentages are based on the total moles of the hydrocarbon-containing gas.

In various embodiments, the hydrocarbon-containing gas comprises little to no hydrogen. For example, the hydrocarbon-containing gas can comprise less than 10, 5, 1, or 0.5 mole percent of hydrogen.

In various embodiments, the hydrocarbon-containing gas can comprise little to no carbon monoxide. For example, the hydrocarbon-containing gas can comprise not more than 20, 10, 5, or 1 mole percent of carbon monoxide.

In various embodiments, the hydrocarbon-containing gas can comprise little to no nitrogen. For example, the hydrocarbon-containing gas can comprise not more than 20, 10, 5, or 1 mole percent of nitrogen.

In various embodiments, the hydrocarbon-containing gas can comprise little to no carbon dioxide. For example, the hydrocarbon-containing gas can comprise not more than 20, 10, 5, or 1 mole percent of carbon dioxide.

In various embodiments, the hydrocarbon-containing gas can comprise little to no sulfur-containing compounds, which includes any compounds containing sulfur. For example, the hydrocarbon-containing gas can comprise not more than 20, 10, 5, or 1 mole percent of sulfur-containing compounds.

Furthermore, the hydrocarbon-containing gas can comprise some amount of $C_2$-$C_5$ components, which includes paraffinic and olefinic isomers thereof. For example, the hydrocarbon-containing gas can comprise less than 30, 25, 15, 10, 5, or 2 mole percent of $C_2$-$C_5$ components.

Additionally, the hydrocarbon-containing gas can comprise some amount of $C_{6+}$ components, which includes hydrocarbon-based compounds having a carbon chain length of at least 6 carbon atoms and the paraffinic and olefinic isomers thereof. For example, the hydrocarbon-containing gas can comprise less than 30, 25, 15, 10, 5, or 2 mole percent of $C_{6+}$ compounds.

Moreover, the hydrocarbon-containing gas can comprise some amount of impurities such as, for example, benzene, toluene, and xylene ("BTX"). For example, the hydrocarbon-containing gas can comprise less than 30, 25, 15, 10, 5, 2, or 1 mole percent of BTX components.

As shown in FIG. 1, the hydrocarbon-containing gas in conduit 110 may initially be routed to a pretreatment zone 14, wherein one or more undesirable constituents may be removed from the gas prior to cooling. In one or more embodiments, the pretreatment zone 14 can include one or more vapor-liquid separation vessels (not shown) for removing liquid water or hydrocarbon components from the feed gas. Optionally, the pretreatment zone 14 can include one or more gas removal zones (not shown), such as, for example, an amine unit or molecular sieve, for removing carbon dioxide and/or sulfur-containing compounds from the gas stream in conduit 110.

The treated gas stream exiting pretreatment zone 14 via conduit 112 can then be routed to a dehydration unit 16, wherein substantially all of the residual water can be removed from the feed gas stream. Dehydration unit 16 can utilize any known water removal system, such as, for example, beds of molecular sieve. Once dried, the gas stream in conduit 114 can have a temperature of at least 5, 10, or 15° C. and/or not more than 50, 45, or 40° C. More particularly, the gas stream in conduit 114 can have a temperature in the range of 5 to 50° C., 10 to 45° C., or 15 to 40° C. Additionally or alternatively, the gas stream in conduit 114 can have a pressure of at least 1.5, 2.5, 3.5, or 4.0 and/or not more than 9.0, 8.0, 7.5, or 7 MPa. More particularly, the gas stream in conduit 114 can have a pressure in the range of 1.5 to 9.0, 2.5 to 8.0, 3.5 to 7.5, or 4.0 to 7.0 MPa.

As shown in FIG. 1, the hydrocarbon-containing feed stream in conduit 114 can be introduced into a first cooling pass 20 of a primary heat exchanger 18. The primary heat exchanger 18 can be any heat exchanger or series of heat exchangers operable to cool and at least partially condense the feed gas stream in conduit 114 via indirect heat exchange with one or more cooling streams. In one or more embodiments, the primary heat exchanger 18 can be a brazed aluminum heat exchanger comprising a single cooling and warming pass (e.g., core) or a plurality of cooling and warming passes (e.g., cores) disposed therein for facilitating indirect heat exchange between one or more process streams and one or more refrigerant streams. Although generally illustrated in FIG. 1 as comprising a single core or "shell," it should be understood that primary heat exchanger 18 can, in some embodiments, comprise two or more separate core or shells, optionally encompassed by a "cold box" to minimize heat gain from the surrounding environment.

The hydrocarbon-containing feed gas stream passing through cooling pass 20 of primary heat exchanger 18 can be cooled and at least partially condensed via indirect heat exchange with the refrigerant stream in respective pass 22, which is described below in further detail. During cooling, a substantial portion of the methane components in the feed gas stream can be condensed out of the vapor phase to thereby provide a cooled, two-phase gas stream in conduit 116. In one or more embodiments, at least 10, 25, 50, 60, 70, 80, or 90 percent of the total amount of methane introduced into primary exchanger 18 via conduit 114 can be condensed within cooling pass 20.

Next, the partially-vaporized gas stream in conduit 116 can then be introduced into a heavies separation vessel 24 that separates the stream into a liquid Natural Gas Liquid (NGL) stream that is methane-poor and an overhead vapor fraction that is methane-rich (conduit 118). As used herein, "methane-poor" and "methane-rich" refer to the methane content of the separated components relative to the methane content of the original component from which the separated components are derived. Thus, a methane-rich component contains a greater mole percentage of methane than the component from which it is derived, while a methane-poor component contains a lesser mole percentage of methane than the component from which it is derived. In the present case, the methane-poor NGL stream contains a lower mole percentage of methane compared to the stream from conduit 116, while the methane-rich overhead stream contains a higher mole percentage of methane compared to the stream from conduit 116. The amounts of the methane-poor bottom stream and the methane-rich overhead stream can vary depending on the contents of the hydrocarbon-containing gas and the operating conditions of the separation vessel 24. In alternative embodiments where no heavier compounds are removed from the partially-vaporized gas stream in conduit 116, the overhead stream 118 can have the same methane content as the stream in conduit 116.

The methane-poor NGL stream can be in the form of a liquid and can contain most of the compounds having 2, 3, 4, 5, or 6 or more carbon atoms originally found in the stream from conduit 116. For example, the methane-poor NGL stream can comprise at least 70, 80, 90, 95, or 99 percent of the compounds having 2, 3, 4, 5, or 6 or more carbon atoms originally present in the stream from conduit 116. In certain embodiments, it may be desirable to remove a $C_2$-$C_{5+}$ stream for use as a product or for other reasons, wherein the $C_2$-$C_{5+}$ stream can comprise at least 70, 80, 90, 95, or 99 percent by weight of the compounds having 2 to 5 carbon atoms originally present in the stream from conduit 116.

The methane-rich overhead vapor stream in conduit 118 can comprise a large portion of methane. For example, the methane-rich overhead vapor stream in conduit 118 can comprise at least about 10, 25, 40, or 50 and/or not more than about 99.9, 99, 95, or 85 mole percent of methane. More particularly, the methane-rich overhead vapor stream in conduit 118 can comprise in the range of about 10 to 99.9, 25 to 99, 40 to 95, or 50 to 85 mole percent of methane. Furthermore, the methane-rich overhead vapor stream in conduit 118 can comprise at least 50, 60, 70, 80, 90, 95, 99, or 99.9 percent of the methane originally present in the stream from conduit 116.

The separation vessel 24 can be any suitable vapor-liquid separation vessel and can have any number of actual or theoretical separation stages. In one or more embodiments, separation vessel 24 can comprise a single separation stage, while in other embodiments, the separation vessel 24 can include 2 to 10, 4 to 20, or 6 to 30 actual or theoretical separation stages. When separation vessel 24 is a multistage separation vessel, any suitable type of column internals, such as mist eliminators, mesh pads, vapor-liquid contacting trays, random packing, and/or structured packing, can be used to facilitate heat and/or mass transfer between the vapor and liquid streams. In some embodiments, when separation vessel 24 is a single-stage separation vessel, few or no column internals can be employed.

In various embodiments, the separation vessel 24 can operate at a pressure of at least 1.5, 2.5, 3.5, or 4.5 and/or 9.0, 8.0, 7.0, or 6.0 MPa. More particularly, the separation vessel 24 can operate at a pressure in the range of 1.5 to 9.0, 2.5 to 8.0, 3.5 to 7.0, or 4.5 to 6.0 MPa.

As one skilled in the art would readily appreciate, the temperature in the separation vessel 24 can vary depending on the contents of the hydrocarbon-containing gas introduced into the system and the desired output. In various embodiments, the separation vessel 24 can operate at a temperature colder than 5, 10, or 15° C. and/or warmer than −195, −185, −175, or −160° C. More particularly, the separation vessel 24 can operate at a temperature in the range of 15 to −195° C., 10 to −185° C., 5 to −175° C., or 5 to −160° C.

As shown in FIG. 1, at least a portion of the methane-rich stream in conduit 118 can be routed to a second cooling pass 26 disposed within the primary heat exchanger 18, wherein the gas stream can be subcooled and at least partially condensed via indirect heat exchange with the refrigerant in respective warming pass 22.

The cooled stream exiting cooling pass 26 via conduit 120 can then be expanded via passage through an expansion device 28, wherein the pressure of the stream can be reduced. The expansion device 28 can comprise any suitable expansion device, such as, for example, a Joule-Thomson valve or a hydraulic turbine. Although illustrated in FIG. 1 as comprising a single device 28, it should be understood that any suitable number of expansion devices can be employed. In certain embodiments, the expansion can be a substantially isenthalpic expansion or isentropic expansion. As used herein, the term "substantially isenthalpic" refers to an expansion or flashing step carried out such that less than 1 percent of the total work generated during the expansion is transferred from the fluid to the surrounding environment. As used herein, "isentropic" expansion refers to an expansion or flashing step in which a majority or substantially all of the work generated during the expansion is transferred to the surrounding environment.

The expanded stream exiting expansion device 28 can be an LNG-enriched product. As used herein, "LNG-enriched" means that the particular composition comprises at least 50 mole percent of methane. The LNG-enriched product in conduit 126 can have a temperature colder than −120, −130, −140, or −145° C. and/or warmer than −195, −190, −180, or −165° C. More particularly, the LNG-enriched product in conduit 126 can have a temperature in the range of −120 to −195° C., −130 to −190° C., −140 to −180° C., or −145 to −165° C.

Turning now to refrigeration cycle 12 of the LNG facility 10 depicted in FIG. 1, this refrigeration cycle is generally described in U.S. Pat. No. 5,657,643, which is incorporated by reference in its entirety. The closed-loop refrigeration cycle 12 is illustrated as generally comprising a turbine and motor 30, a first refrigerant compressor 32, a second refrigerant compressor 34, a refrigerant suction drum 36, an optional interstage cooler 38, an interstage accumulator 40, a first refrigerant pump 42, a refrigerant condenser 44, a refrigerant accumulator 46, and a second refrigerant pump 48. In certain embodiments, the turbine and motor 30 can be used to drive the first refrigerant compressor 32 and the second refrigerant compressor 34.

While FIG. 1 depicts an LNG facility with only a single closed loop refrigeration cycle, the LNG facility may also utilize additional closed refrigeration cycles to form the LNG product. For example, in such embodiments, the LNG facility could contain a "first" closed refrigeration loop and a "second" closed refrigeration loop, which sequentially cool the LNG stream. In such embodiments, the "first" closed refrigeration loop would first cool the hydrocarbon-containing gas feed stream to form a cooled feed stream and the "second" closed refrigeration loop would further cool the cooled feed stream to form the LNG product. Exemplary LNG facilities that utilize two different closed loop refrigeration cycles are described in U.S. Patent Application Publication No. 2016/0061517, the disclosure of which is incorporated herein by reference in its entirety.

Turning back to FIG. 1, the warmed mixed refrigerant stream withdrawn from warming pass 22 in the primary heat exchanger 18 via conduit 122 can be routed to the refrigerant suction drum 36. After leaving the suction drum 36, the mixed refrigerant stream in conduit 124 can be routed to a suction inlet of the first refrigerant compressor 32, wherein the pressure of the refrigerant stream can be increased. Subsequently, a partially compressed refrigerant stream may exit the first refrigerant compressor 32 via conduit 126 and be routed to interstage cooler 38, wherein the stream can be cooled and at least partially condensed via indirect heat exchange with a cooling medium (e.g., cooling water or air).

The resulting two-phase stream in conduit 128 can be introduced into interstage accumulator 40, wherein the vapor and liquid portions can be separated. A vapor stream withdrawn from accumulator 40 via conduit 130 can be routed to the inlet of the second refrigerant compressor 34, wherein the stream can be further compressed into a compressed refrigerant stream. The compressed refrigerant vapor stream may exit the accumulator 40 via conduit 132. Additionally, the remaining liquid phrase refrigerant may be withdrawn from the interstage accumulator 40 via conduit 134 and pumped to pressure via the first refrigerant pump 42. The stream in conduit 136 from the first refrigerant pump 42 can be joined with the resulting compressed refrigerant vapor stream in conduit 132 to form the combined stream in conduit 138.

The combined refrigerant stream in conduit 138 can then be routed to refrigerant condenser 44, wherein the pressurized refrigerant stream can be cooled and at least partially condensed via indirect heat exchange with a cooling medium (e.g., cooling water) before being introduced into the refrigerant accumulator 46 via conduit 140. As shown in FIG. 1, the vapor and liquid portions of the two-phase refrigerant stream in conduit 140 can be separated and separately withdrawn from refrigerant accumulator 46 via respective conduits 142 and 144. Optionally, a portion of the liquid stream in conduit 144 can be pressurized via the second refrigerant pump 48 to form the pressurized refrigerant stream in conduit 146. A control valve 50 is used to regulate the flow of the refrigerant stream in conduit 146. The refrigerant stream in conduit 148 from control valve 50 can be combined with the vapor stream in conduit 142 just prior to being introduced in or within the refrigerant cooling pass 52 disposed within the primary heat exchanger 18, as shown in FIG. 1. In one or more embodiments, recombining a portion of the vapor and liquid portions of the compressed refrigerant in this manner may help ensure proper fluid distribution within the refrigerant cooling pass 52.

As the compressed refrigerant stream flows through refrigerant cooling pass 52, the stream is condensed and sub-cooled, such that the temperature of the liquid refrigerant stream withdrawn from primary heat exchanger 18 via conduit 150 is well below the bubble point of the refrigerant mixture. The sub-cooled refrigerant stream in conduit 150 can then be expanded via passage through an expansion device 54 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 152 can then be routed through the refrigerant warming pass 22, wherein a substantial portion of the refrigeration generated via the expansion of the refrigerant can be recovered as cooling for one or more process streams, including the refrigerant stream flowing through cooling pass 52, as discussed in detail previously. Upon leaving the refrigerant warming pass 22, the warmed refrigerant in conduit 122 can be recycled into the refrigeration cycle as described above.

In one or more embodiments, the refrigerant utilized in the closed-loop refrigeration cycle 12 can be a mixed refrigerant. As used herein, the term "mixed refrigerant" refers to a refrigerant composition comprising two or more constituents. In various embodiments, the mixed refrigerant can comprise two or more constituents selected from the group consisting of nitrogen, methane, ethylene, ethane, propylene, propane, isobutane, n-butane, isopentane, n-pentane, and combinations thereof. In some embodiments, the refrigerant composition can comprise methane, nitrogen, ethane, propane, normal butane, and isopentane and can substantially exclude certain components, including, for example, halogenated hydrocarbons. In one or more embodiments, the mixed refrigerant comprises compounds selected from a group consisting of nitrogen and hydrocarbons containing from 1 to about 5 carbon atoms. In certain embodiments, the mixed refrigerant can comprise the following mole fraction percentage ranges: 0 to about 15% of $N_2$; about 20 to about 36% $C_1$; about 20 to about 40% of $C_2$; about 2 to about 20% of $C_3$; 0 to about 10% of $C_4$; and about 2 to about 25% of $C_5$." According to one or more embodiments, the refrigerant composition can have an initial boiling point of at least −80, −85, or −90° C. and/or not more than −50, −55, or −60° C. Various specific refrigerant compositions are contemplated according to embodiments of the present invention.

In some embodiments of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed gas stream introduced into LNG recovery facility 10. In one embodiment, the composition of the mixed refrigerant can be adjusted such that the heating curve of the vaporizing refrigerant more closely matches the cooling curve of the feed gas stream. One method for such curve matching is described in detail in U.S. Pat. No. 4,033,735, the disclosure of which is incorporated herein by reference in its entirety.

Turning back to FIG. 1, the refrigeration cycle 12 can be used to cool other process loads within the LNG facility 10. As shown in FIG. 1, the LNG facility 10 can contain an auxiliary refrigeration cycle 56. In order to provide the initial cooling to the auxiliary refrigeration cycle 56, at least a portion of the pressurized liquid refrigerant stream in conduit 146 can be routed to an auxiliary heat exchanger 58 via conduit 154. As used herein, the auxiliary heat exchanger 58 may also be referred to as an "indirect" heat exchanger. In certain embodiments, the auxiliary heat exchanger 58 may be a water chiller. Generally, the auxiliary heat exchanger 58 can be any conventional heat exchanger known in the art that is capable of providing the necessary cooling. In one or more embodiments, the auxiliary heat exchanger can be a core-and-kettle heat exchanger, a shell-and-tube exchanger, a stand-alone printed circuit heat exchanger, or a stand-alone plate-and-frame exchanger.

As shown in FIG. 1, the pressurized liquid refrigerant from conduit 154 can pass through cooling pass 60 disposed within the auxiliary heat exchanger 58, while a heat transfer stream can be cooled in cooling pass 62, which is also disposed within the auxiliary heat exchanger 58. As discussed in further detail below, cooling passes 60 and 62 are both cooled via refrigeration provided by warming pass 64.

After leaving refrigerant cooling pass 60, the refrigerant stream in conduit 156 can then be expanded via passage through an expansion device 66 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 158 can then be routed through the refrigerant warming pass 64, wherein a substantial portion of the refrigeration generated via the expansion of the refrigerant can be recovered as cooling for one or more process streams, including the refrigerant stream flowing through cooling pass 60 and the heat transfer stream flowing through cooling pass 62, as discussed in detail previously. Upon leaving the refrigerant warming pass 64, the warmed refrigerant can be recycled back into the refrigeration cycle 12 by being added to the stream in conduit 128 and prior to the introduction in the interstage accumulator 40.

As shown in FIG. 1, the heat transfer stream can be cooled in cooling pass 62 to produce a cooled and condensed heat transfer stream in conduit 162. In one or more embodiments, the condensed heat transfer stream comprises less than 10, 5, 4, 3, 2, 1, or 0.1 mole percent of vapor. Additionally, in various embodiments, the cooled heat transfer stream in conduit 162 can have a temperature of at least −50° C., −40° C., −30° C., −25° C., or −20° C. and/or not more than 50° C., 40° C., 30° C., 25° C., 20° C., or 16° C.

In various embodiments, the heat transfer stream can comprise, consist essentially of, or consist of water, a glycol, or combinations thereof. Exemplary glycols include propylene glycol and ethylene glycol.

As depicted in FIG. 1, the cooled heat transfer stream in conduit 162 can be used to provide additional cooling to other process loads within the LNG facility 10. In one or more embodiments, at least a portion of the cooled heat transfer stream in conduit 162 can be routed via conduit 164 to interstage cooler 68, wherein the cooled heat transfer stream can be used to provide cooling via indirect heat exchange to other process cooling services in the LNG facility 10 (not pictured) such as, for example, distillation tower overhead condensers and other process coolers, in order to enhance the plant efficiency, capacity, and/or product purity. For example, in such embodiments, the interstage cooler 68 functions as a heat exchanger that has a cooling pass disposed therein that can be used to cool, for instance, the overhead stream from a distillation column and/or a condensed stream from a condenser. After leaving the interstage cooler 68, the warmed heat transfer fluid can be routed via conduit 166 to conduit 168 in order to be recycled and reused within the auxiliary refrigeration cycle 56.

Additionally or alternatively, in certain embodiments, at least a portion of the cooled heat transfer stream in conduit 162 can be routed via conduit 170 to interstage cooler 70, wherein the cooled heat transfer stream can be used to provide cooling via indirect heat exchange to the hydrocarbon-containing gas feed stream prior to introducing the feed stream into the primary heat exchanger 18. In one or more embodiments, the cooled heat transfer stream can be used to provide additional cooling to the dehydration unit in the dehydration zone 16. For example, in such embodiments, the interstage cooler 70 functions as a heat exchanger that has a cooling pass disposed therein that can be used to cool the hydrocarbon-containing gas feed stream prior to introducing the feed stream into the single closed loop refrigeration cycle 12. Consequently, this can reduce the load on the upstream gas dehydration units and also increase the overall efficiency of the plant. After leaving the interstage cooler 70, the warmed heat transfer fluid can be routed via conduit 172 to conduit 168 in order to be recycled and reused within the auxiliary refrigeration cycle 56.

Additionally or alternatively, in certain embodiments, at least a portion of the cooled heat transfer stream in conduit 162 can be routed via conduit 174 to interstage cooler 72, wherein the cooled heat transfer stream can be used to provide cooling via indirect heat exchange to the uncompressed air inlet stream of the turbine/motor 30. For example, in such embodiments, the interstage cooler 72 functions as a heat exchanger that has a cooling pass disposed therein that can be used to cool the uncompressed air that is utilized by the turbine/motor 30. As used herein, "uncompressed air" refers to an air stream that has not been previously compressed in a compressor. Consequently, this can result in a higher power output from the gas turbine(s) and increase plant capacity and efficiency. After leaving the interstage cooler 72, the warmed heat transfer fluid can be routed via conduit 175 to conduit 168 in order to be recycled and reused within the auxiliary refrigeration cycle 56.

The warmed heat transfer fluid in conduit 168 can be routed via conduit 176 to a chilled water expansion drum 74, which can expand and contract the heat transfer fluid. Upon leaving the expansion drum 74, the warmed heat transfer fluid in conduit 168 can be pumped via chilled water pump 76 through conduit 178 back into cooling pass 62 disposed in the auxiliary heat exchanger 58, which was previously described.

While FIG. 1 depicts various embodiments of the present invention, other embodiments are envisioned, such as those depicted in FIGS. 2 and 3, which are described in further detail below. Before discussing the processes and systems depicted in FIGS. 2 and 3, it should be noted that all common system components found in FIGS. 1-3 are all marked accordingly using the same numerals. For example, the primary heat exchanger 18 is consistently labeled throughout FIGS. 1-3. Furthermore, the common system components depicted in FIGS. 1-3 are expected to function in the same or substantially similar manner, unless otherwise noted.

FIG. 2 depicts various positions within the single closed-loop refrigeration cycle 12 where at least a portion of the liquid mixed refrigerant stream may be routed from the cycle in order to provide cooling to the auxiliary refrigeration cycle 56. In particular, FIG. 2 depicts four different positions marked (A)-(D), wherein the liquid mixed refrigerant stream may be routed from in order to provide cooling to the auxiliary refrigeration cycle 56.

At position (A) in FIG. 2, at least a portion of the compressed liquid refrigerant stream in conduit 134 can be removed via conduit 180. The liquid refrigerant stream in conduit 180 can then be expanded via passage through an expansion device 80 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 184 can then be routed to conduit 186 for subsequent cooling uses.

At position (B) in FIG. 2, at least a portion of the pressurized liquid refrigerant stream in conduit 146 can be removed via conduit 188. The liquid refrigerant stream in conduit 188 can then be expanded via passage through an expansion device 82 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 190 can then be routed to conduit 186 for subsequent cooling uses.

At position (C) in FIG. 2, at least a portion of the liquid refrigerant stream in cooling pass 52 can be removed via conduit 192. The liquid refrigerant stream in conduit 192 can then be expanded via passage through an expansion device 84 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 194 can then be routed to conduit 186 for subsequent cooling uses.

At position (D) in FIG. 2, at least a portion of the liquid refrigerant stream from conduit 150 can be removed via conduit 196. The liquid refrigerant stream in conduit 196 can then be expanded via passage through an expansion device 86 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 198 can then be routed to conduit 186 for subsequent cooling uses.

As shown in FIG. 2, the two-phase refrigerant stream in conduit 186 can be routed to interstage cooler 88, wherein the two-phase refrigerant stream can be used to cool the heat transfer fluid in the auxiliary refrigeration cycle 56 via indirect heat exchange. After cooling the heat transfer fluid in the interstage cooler 88, the refrigerant stream can then be routed via conduit 200 to expansion devices 90 or 92 (illustrated herein as Joule-Thompson valves, although other types of expansion devices may be used) via conduits 202 or 204, wherein the pressure of the stream can be reduced, thereby cooling and at least partially vaporizing the refrigerant stream. Upon leaving expansion devices 90 or 92, the refrigerant stream can be reintroduced into the single closed-loop refrigeration cycle 12.

Turning again to the auxiliary refrigeration cycle 56 depicted in FIG. 2, the cooled heat transfer fluid is removed from the interstage cooler 88 via conduit 206 and introduced into interstage cooler 94, wherein the cooled heat transfer stream can be used to provide cooling via indirect heat exchange to the uncompressed air stream in conduit 208, which is subsequently introduced into the turbine/motor 30. Consequently, this can result in a higher power output from the gas turbine(s) and increase plant capacity and efficiency.

The warmed heat transfer fluid in conduit 210 can be routed via conduit 212 to a chilled water expansion drum 74, which can expand and contract the heat transfer fluid. Upon leaving the expansion drum 74, the warmed heat transfer fluid in conduit 210 can be pumped via chilled water pump 76 through conduit 214 back into interstage cooler 88 for cooling.

Turning now to the LNG facility 10 depicted in FIG. 3, this figure depicts a facility wherein at least a portion of the liquid refrigerant from the single closed-loop refrigeration cycle 12 can be rerouted at different intervals to directly provide cooling to the uncompressed air inlet stream of the turbine/motor 30. In particular, FIG. 3 depicts four different positions marked (A)-(D), wherein at least a portion of the liquid mixed refrigerant stream may be rerouted from in order to directly provide cooling to the gas turbine combustion air inlet.

At position (A) in FIG. 3, at least a portion of the compressed liquid refrigerant stream in conduit 136 can be removed via conduit 180. The liquid refrigerant stream in conduit 180 can then be expanded via passage through expansion device 80 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 184 can then be routed to conduit 186 for subsequent cooling uses.

At position (B) in FIG. 3, at least a portion of the pressurized liquid refrigerant stream in conduit 146 can be removed via conduit 188. The liquid refrigerant stream in conduit 188 can then be expanded via passage through expansion device 82 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 190 can then be routed to conduit 186 for subsequent cooling uses.

At position (C) in FIG. 3, at least a portion of the liquid refrigerant stream in cooling pass 52 can be removed via conduit 192. The liquid refrigerant stream in conduit 192 can then be expanded via passage through expansion device 84 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 194 can then be routed to conduit 186 for subsequent cooling uses.

At position (D) in FIG. 3, at least a portion of the liquid refrigerant stream from conduit 150 can be removed via conduit 196. The liquid refrigerant stream in conduit 196 can then be expanded via passage through an expansion device 86 (illustrated herein as Joule-Thompson valve, although other types of expansion devices may be used), wherein the pressure of the stream can be reduced, thereby cooling and at least partially vaporizing the refrigerant stream. The cooled, two-phase refrigerant stream in conduit 198 can then be routed to conduit 186 for subsequent cooling uses.

As shown in FIG. 3, the two-phase refrigerant stream in conduit 186 can be routed to the turbine and motor 30, where the refrigerant stream can cool the inlet air stream going into the turbine. After cooling the turbine inlet air, the refrigerant stream can then be routed via conduit 210 to expansion devices 90 or 92 (illustrated herein as Joule-Thompson valves, although other types of expansion devices may be used) via conduits 212 or 214, wherein the pressure of the stream can be reduced, thereby cooling and at least partially vaporizing the refrigerant stream. Upon leaving expansion devices 90 or 92, the refrigerant stream can be reintroduced into the single closed-loop refrigeration cycle 12.

Although not depicted in FIG. 3, the liquid refrigerant streams rerouted from positions (A)-(D) can also be used to directly cool other process systems utilized in the LNG facility including, for example, the dehydration unit used in the dehydration zone 16, a distillation column overhead condenser, and/or other process coolers.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

DEFINITIONS

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, the terms "first," "second," "third," and the like are used to describe various elements and such elements should not be limited by these terms. These terms are only used to distinguish one element from another and do not necessarily imply a specific order or even a specific element. For example, an element may be regarded as a "first" element in the description and a "second element" in the claims without departing from the scope of the present invention. Consistency is maintained within the description and each independent claim, but such nomenclature is not necessarily intended to be consistent therebetween.

NUMERICAL RANGES

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

What is claimed is:

1. A process for producing liquid natural gas (LNG) from a natural gas stream in an LNG liquefaction plant, the process comprising:

(a) compressing a mixed refrigerant in a refrigerant compressor using a combustion gas turbine having an inlet air stream as the compressor driver, thereby forming a compressed mixed refrigerant stream;

(b) cooling and at least partially condensing the compressed mixed refrigerant stream, thereby forming a first two-phase mixed refrigerant stream;

(c) separating the first two-phase mixed refrigerant stream, thereby forming a vapor mixed refrigerant stream and a liquid mixed refrigerant stream;

(d) combining the vapor mixed refrigerant stream and a first portion of the liquid mixed refrigerant stream, thereby forming a second two-phase mixed refrigerant stream;

(e) condensing the two-phase mixed refrigerant stream via indirect heat exchange with an expanded mixed refrigerant stream, thereby forming a condensed mixed refrigerant stream;

(f) expanding the condensed mixed refrigerant stream, thereby forming the expanded mixed refrigerant stream in step (e);

(g) liquefying the natural gas stream via indirect heat exchange with the expanded mixed refrigerant stream, thereby forming the liquid natural gas and a first warmed mixed refrigerant stream;

(h) expanding a second portion of the liquid mixed refrigerant stream, thereby forming a third two-phase mixed refrigerant stream;

(i) cooling a heat transfer fluid via indirect heat exchange with the third two-phase mixed refrigerant stream, thereby forming a cooled heat transfer fluid and a second warmed mixed refrigerant stream; and (j) cooling the combustion gas turbine inlet air stream in step (a) via indirect heat exchange with the cooled heat transfer fluid, wherein the first warmed mixed refrigerant stream and the second warmed mixed refrigerant stream are returned to the compressor in step (a).

2. The process of claim 1, wherein the cooling and partial condensation of step (b) is performed via indirect heat exchange with a cooling medium comprising water or air.

3. The process of claim 1, wherein the first warmed mixed refrigerant stream is returned to a suction inlet of the refrigerant compressor.

4. The process of claim 1, wherein the second warmed mixed refrigerant stream is returned to a suction inlet of the refrigerant compressor.

5. The process of claim 1, wherein prior to step (b), further compressing the mixed refrigerant in a second refrigerant compressor using the combustion gas turbine as the compressor driver, thereby forming the compressed mixed refrigerant that is cooled in step (b).

6. The process of claim 5, wherein the second warmed mixed refrigerant stream is returned to a second suction inlet of the second refrigerant compressor.

7. The process of claim 1, wherein the heat transfer fluid comprises water, a glycol, or combinations thereof.

8. A process for producing liquid natural gas (LNG) from a natural gas stream in an LNG liquefaction plant, the process comprising:

(a) compressing a mixed refrigerant in a compressor using a combustion gas turbine having an inlet air stream as the compressor driver, thereby forming a compressed mixed refrigerant stream;

(b) cooling and at least partially condensing the compressed mixed refrigerant stream, thereby forming a first two-phase mixed refrigerant stream;

(c) separating the first two-phase mixed refrigerant stream, thereby forming a vapor mixed refrigerant stream and a liquid mixed refrigerant stream;

(d) combining the vapor stream and the liquid stream, thereby forming a second two-phase mixed refrigerant stream;

(e) condensing the two-phase mixed refrigerant stream via indirect heat exchange with an expanded mixed refrigerant stream, thereby forming a condensed mixed refrigerant stream;

(f) expanding a first portion of the condensed mixed refrigerant stream, thereby forming the expanded mixed refrigerant stream in step (e);

(g) liquefying the natural gas stream via indirect heat exchange with the expanded mixed refrigerant stream, thereby forming the liquid natural gas and a first warmed mixed refrigerant stream;

(h) expanding a second portion of the condensed mixed refrigerant stream, thereby forming a third two-phase mixed refrigerant stream;

(i) cooling a heat transfer fluid via indirect heat exchange with the third two-phase mixed refrigerant stream, thereby forming a cooled heat transfer fluid and a second warmed mixed refrigerant stream; and (j) cooling the combustion gas turbine inlet air stream in step (a) via indirect heat exchange with the cooled heat transfer fluid, wherein the first warmed mixed refrigerant stream and the second warmed mixed refrigerant stream are returned to the compressor in step (a).

9. The process of claim 8, wherein the cooling and partial condensation of step (b) is performed via indirect heat exchange with a cooling medium comprising water or air.

10. The process of claim 8, wherein the first warmed mixed refrigerant stream is returned to a suction inlet of the refrigerant compressor.

11. The process of claim 8, wherein the second warmed mixed refrigerant stream is returned to a suction inlet of the refrigerant compressor.

12. The process of claim 8, wherein prior to step (b), further compressing the mixed refrigerant in a second refrigerant compressor using the combustion gas turbine as the compressor driver, thereby forming the compressed mixed refrigerant that is cooled in step (b).

13. The process of claim 12, wherein the second warmed mixed refrigerant stream is returned to a second suction inlet of the second refrigerant compressor.

14. The process of claim 8, wherein the heat transfer fluid comprises water, a glycol, or combinations thereof.

15. The process of claim 8, wherein at least a portion of the liquid stream is pressurized in a pump prior to the combining in step (d).

* * * * *